US005185045A

United States Patent [19]

Peters et al.

[11] Patent Number: 5,185,045

[45] Date of Patent: Feb. 9, 1993

[54] THERMOMECHANICAL PROCESS FOR TREATING TITANIUM ALUMINIDES BASED ON $TI_3AL$

[75] Inventors: Manfred Peters, Bad Honnef; Karl-Josef Grundhoff, Troisdorf; Hartmut Schurmann, Neunkirchen Seelscheid, all of Fed. Rep. of Germany; Yong-Tai Lee, Changwon, Rep. of Korea

[73] Assignee: Deutsche Forschungsanstalt für Luftund Raumfahrt e.V. Linder Höhe, Köln, Fed. Rep. of Germany

[21] Appl. No.: 735,958

[22] Filed: Jul. 25, 1991

[30] Foreign Application Priority Data

Jul. 27, 1990 [DE] Fed. Rep. of Germany ..... 4023816

[51] Int. Cl.[5] ..... C22C 14/00

[52] U.S. Cl. ..... 148/671; 148/421; 148/670; 420/421

[58] Field of Search ..... 148/12.7 B, 11.5 F, 148/421, 670, 671; 420/418

[56] References Cited

U.S. PATENT DOCUMENTS

| | | | |
|---|---|---|---|
| 4,716,020 | 12/1987 | Blackburn et al. | 420/418 |
| 4,842,653 | 6/1989 | Wirth et al. | 148/11.5 F |
| 4,919,886 | 4/1990 | Venkataraman et al. | 420/420 |
| 5,032,357 | 7/1991 | Rowe | 420/418 |

FOREIGN PATENT DOCUMENTS 1298128 12/1989 Japan .

OTHER PUBLICATIONS

Kim et al Jour of Metals, Aug. 1991, pp. 40–47.

*Primary Examiner*—Upendra Roy

*Attorney, Agent, or Firm*—Wegner, Cantor, Mueller & Player

[57] ABSTRACT

A process as described for treating $Ti_3Al$-based alloys comprising, in addition to titanium and aluminum as $\alpha$-phase-stabilizing element, niobium and further elements stabilizing the $\beta$-phase in an amount of from 20 to 30% by weight, wherein the further elements stabilizing the $\beta$ phase are present in an amount of at least 4% by weight by (a) preparing the alloys by melting or via the powder-metallurgical route, (b) deforming at a temperature within the $(\alpha_2+\beta)$-phase area by more than 60% in one or more steps with stress-relief annealing without complete recrystallization effected between these steps, (c) solution annealing the formed part for from 5 minutes to 120 minutes below the $\beta$-transus temperature of the alloy, (d) quenching, and (e) subsequent aging/stress-relief annealing at temperatures within the range of from 500° for 75° C. for from 0.5 to 24 hours.

9 Claims, 4 Drawing Sheets

THERMOMECHANICAL PROCESS FOR TREATING TITANIUM ALUMINIDES BASED ON $TI_3AL$

BACKGROUND OF THE INVENTION

1. Field of the Invention

The invention relates to a thermomechanical process for treating $Ti_3Al$-based titanium aluminides in order to achieve extremely high strength values. Said alloys have in common a ratio by weight of titanium to aluminum of about 3:1, so that the alloys which hereinafter are designated as $(\alpha_2+\beta)$-titanium alloys contain about 25% atomic percent, corresponding to about 14% by weight, of aluminum.

2. Description of the Related Art

It is known that the mechanical properties of titanium can already be improved by means of alloying additions. The temperature of transformation of titanium from the $\alpha$ into the $\beta$ phase can be raised or lowered by the addition of certain alloying elements, i.e. a distinction is made between alloying elements that stabilize either the $\alpha$ or the $\beta$ phase. For example, aluminum is among the $\alpha$-stabilizing alloying elements and is dissolved as a substitutional mixed crystal. Examples of $\beta$-stabilizing alloying elements in the first place are niobium, vanadium and molybdenum. Zirconium and tin are well soluble in both phases.

According to the different phases existing upon cooling at room temperature after annealing, the titanium alloys are subdivided, inter alia, into $\alpha$-titanium alloys, $\beta$-titanium alloys, $(\alpha+\beta)$- or $(\alpha_2+\beta)$-titanium alloys. It is specifially this definite last-mentioned type of alloys which the present invention relates to.

In recent years there has been no lack of attempts to improve the static and dynamic mechanical properties of the $(\alpha+\beta)$-titanium alloys by means of a thermomechanical treatment, wherein the materials first are usually hot-worked, since their elongation before reduction of area is small. By means of solution annealing and stabilization, it is then possible to achieve better material properties such as, for example, an increased fatigue strength.

From the German Offenlegungsschrift [Published Unexamined Patent Application] 36 22 433.2 and the U.S. Pat. No. 4,842,653 corresponding thereto there have been known $(\alpha+\beta)$-titanium alloys and a process for improving the static and dynamic mechanical properties. It has been described that a thermomechanical treatment of said alloys may result in an increase in strength.

In addition to the above-mentioned $(\alpha+\beta)$-titanium alloys which usually contain about 6% by weight of aluminum, there have also been described $(\alpha_2+\beta)$-titanium alloys and the properties thereof in prior art, which alloys are distinguished by the higher aluminum content.

TIMET, Data Sheet, Timet, Pittsburgh, Pa., U.S.A., 1989, for an alloy Ti-14Al-20Nb-3V-2Mo, reports a 0.2%-offset yield strength (hereinbelow denoted as yield point) of 793 MPa, a tensile strength of 1000 MPa and an elongation at break of 2% at room temperature. For 650° C. there are reported a yield point of 586 MPa, a tensile strength of 793 MPa, and an elongation at break of 10%.

RMI Titanium Data Sheet, RMI, Niles, Ohio, U.S.A., 1989, for a Ti-14Al-21Nb alloy describes a yield point 655 Mpa, a tensile strength of 827 MPa and an elongation at break at 2% at room temperature. The respective values at 650° C. are 483 MPa for the yield point, 655 MPa for the tensile strength, and 8% for the elongation at break.

W. Cho, A. W. Thompson and J. C. Williams, Metallurgical Transactions 21A (1990), 641–651, describe a heat treatment of an alloy Ti-25Al-10Nb-3V-1Mo. After forging the alloy in the $(\alpha_2+\beta)$-phase area, a solution annealing is carried out in the area of the $\beta$ phase without subsequent deformation. This step is followed by cooling in air. This results in an alloy having a yield point of 1180 MPa, a tensile strength of 1300 MPa and an elongation at break of 4%.

C. H. Ward, J. C. Williams, A. W. Thompson, D. G. Rosenthal and F. H. Froes, Proc. 6th World Conference on Titanium, pages 1103–1108, Cannes, France, 1988, describe an alloy having the nominal composition of Ti-25Al-10Nb-3V-1Mo (each in atomic percent) and a heat treatment. The molded parts forged under 70% reduction in area are subjected to a heat treatment. In said heat treatment there is effected either a direct stress-relief annealing/ageing into a salt bath, or the treatment in the salt bath was carried out only after a $(\alpha_2+\beta)$-solution treatment. The tensile test characteristics obtained are 942 MPa for the yield point, 1097 MPa for the tensile strength, and 2,7% for the elongation at break, and 703 MPa for the yield point, 907 MPa for the tensile strength, and 1.6% for the elongation at break.

From A. K. Gogia, D. Banerjee and T. K. Nandy, Metallurgical Transactions 21A (1990), pages 609–625, and from S. J. Balsone, in Oxidation of High Temperature Intermetallics I. Grobstein und J. Doychack, The Minerals, Metals and Materials Society, 1989, pages 219–234, there have been known heat treatments of $(\alpha_2+\beta)$-titanium alloys which, besides titanium and aluminum, contain niobium as a further element, while the tensile strength properties of said alloys have not been improved in comparison to those mentioned above.

SUMMARY OF THE INVENTION

Since the aerospace industry, as the largest consumer of titanium alloys, is interested in improved mechanical properties of said alloys, it was the object of the present invention to provide a process for producing $(\alpha_2+\beta)$-titanium alloys, and by means being said process the $(\alpha_2+\beta)$-titanium alloys themselves, which have yield points and tensile strength values of unambiguously higher than 1100 MPa, and especially higher than 1300 MPa up to ranges of 1600 MPa and above and, moreover, are capable of surviving stress cycles until break which are superior to those of the $(\alpha+\beta)$- and $(\alpha_2+\beta)$-titanium alloys of comparable compositions as obtainable by the conventional processes of the art.

DETAILED DESCRIPTION OF THE INVENTION

Figure 1:
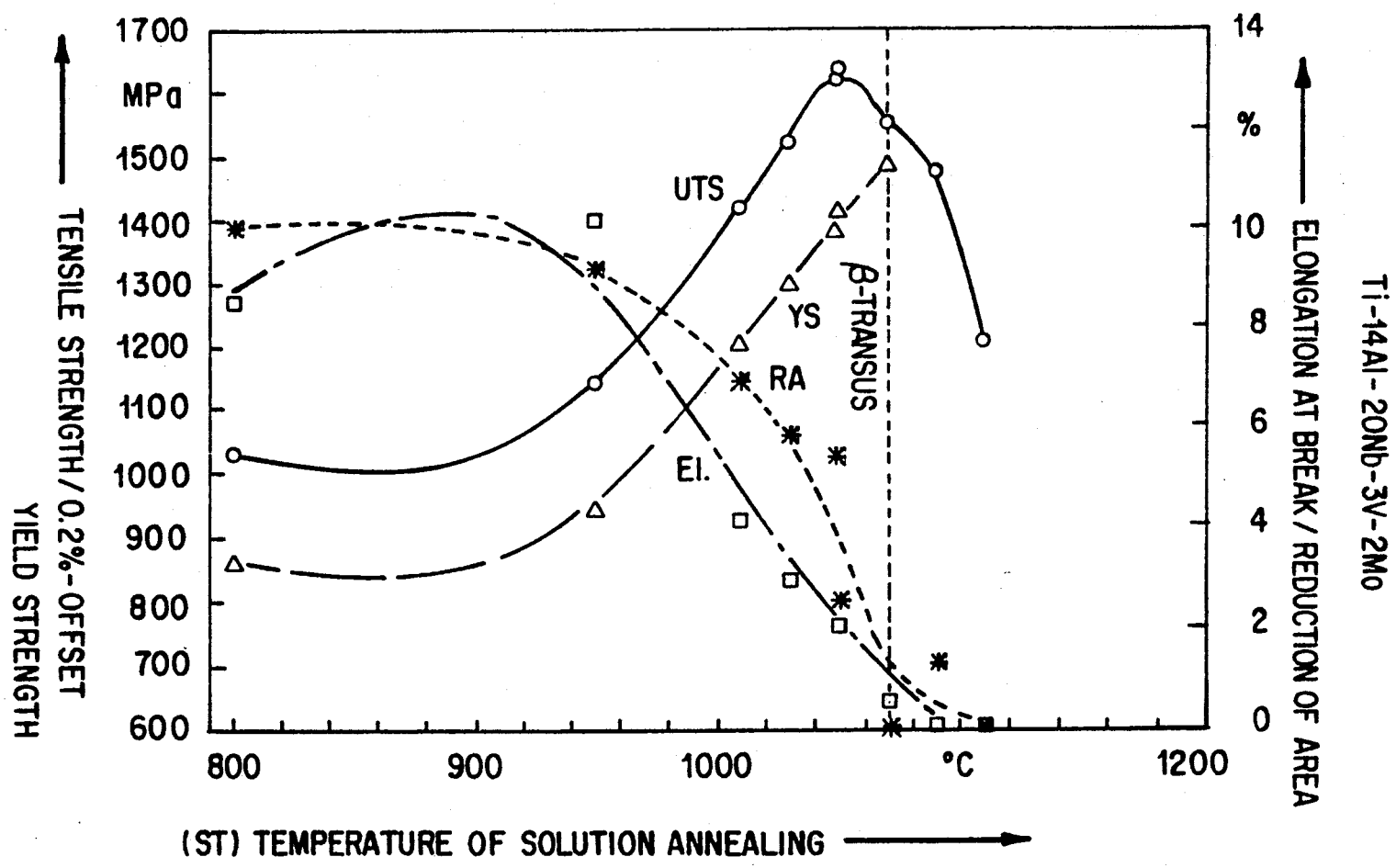
FIG. 1 illustrates the dependence of ultimate tensile strength (UTS), yield strength (YS), elongation at break point (El.), and reduction in area at break point (RA) as a function of solution annealing temperature of the alloys of the present invention.

The object outlined above is attained by a thermomechanical process for treating $Ti_3Al$-based alloys containing, in addition to titanium and aluminum as $\alpha$ phase-stabilizing element, niobium and further elements stabilizing the $\beta$ phase in an amount of from 20 to 30% by weight, wherein the further elements stabilizing the $\beta$ phase are present in an amount of at least 4% by weight by (a) preparing the alloys by melting or via the powder-metallurgical route, (b) deforming at a temperature within the $(\alpha_2+\beta)$-phase area by more than 60% in one or more step(s) with stress-relief annealing without complete recrystallization being effected between these step(s), (c) solution annealing the formed part for from 5 minutes to 120 minutes below the $\beta$-transus temperature of the alloy, (d) quenching, and (e) subsequent ageing/stress-relieve annealing at temperatures within the range of from 500° for 750° C. for from 0.5 to 24 hours.

Deformation by more than 60%, as first required according to the invention, of the $(\alpha_2+\beta)$-titanium alloys, some examples of which have been mentioned above and which have been prepared by melting or via the powder-metallurgical route may be appropriately effected by forging, pressing, swaging, rolling or drawing; between the individual deformation steps, the microstructure of the alloy may be stress-relieved by annealing, while attention is to be given that said microstructure does not completely recrystallize. Therefore, extended periods of in-between annealing are to be avoided in any event. The deformation temperature may in theory be lowered down to room temperature. However, in practice there are limits imposed by that the material is difficult to deform, so that a sufficient deformation will hardly be possible below about 800° C.

The shaped part present in the desired final dimensions is then solution-annealed; that is, annealing is effected for from 5 minutes to 120 minutes, and especially for from 5 minutes to 30 minutes below the $\beta$-transus, i.e. within the $(\alpha_2+\beta)$-phase range. For example, for the alloy Ti-14Al-20Nb-3V-2Mo (% by weight) the $\beta$-transus is approximately 1070° C. Solution annealing is preferred to be carried out closely below the $\beta$-transus, especially at temperatures that are from 5° C. to 60° C. lower. The material is then quenched, suitable quenching means being familiar to the artisan. However, quenching preferably is effected using water, oil or both means.

In order to achieve a stabilization of the microstructure, the quenched shaped parts are subsequently aged and annealed for stress-relief at temperatures within the range of from 500° C. to 750° C., and preferably from 650° C. to 700° C., for from 0.5 to 24 hours, preferably from 0.5 to 6 hours.

With the present invention there is provided a thermomechanical treatment process which drastically increases the strenght yield point and tensile strength at room temperature and temperatures up to more than 700° C. and the fatigue strengh of certain titanium aluminides based on $Ti_3Al$ comprising additional alloying elements.

In comparison to the alloys known from prior art, the strength of the $(\alpha_2+\beta)$-titanium alloys to be used according to the invention could be increased by more than 50% due to the thermomechanical treatment. Even at 650° C., the strength values of the thermomechanically treated work piece are still significantly higher than those of the initially supplied [as received] material at room temperature, whereby the excellent high temperature strength properties are clearly demonstrated.

Also, an excellent high cycle fatigue behavior of the materials was observed after the treatment according to the invention.

The extremely high strength values achieved after the thermomechanical treatment are supposed to be due to a very fine recrystallized microstructure.

In a preferred embodiment there are further employed, as the $\beta$ phase-stabilizing elements in addition to niobium, molybdenum and vanadium in an amount of 5% by weight, relative to the alloy. Especially preferred is a content of the $\beta$ phase-stabilizing elements such as niobium, molybdenum and vanadium of 25% by weight, relative to the alloy.

Especially preferred is an alloy having the composition of Ti-14Al-20Nb-3V-2Mo (each expressed in % by weight), corresponding to Ti-25Al-10Nb-3V-1Mo (each expressed in atomic percent), which is known in the art also under the designation of "Super-alpha-2".

The excellent mechanical properties—which are unambiguously superior to those of the comparative alloys known so far—of the $(\alpha_2+\beta)$-titanium alloys produced according to the invention are shown in the following Tables I and II and in the FIGS. 1 through 4.

EXAMPLES

As the starting material there was employed a commercial alloy Ti-14Al-20Nb-3V-2Mo (in % by weight) having the following tensile properties: Yield strength 907 MPa, tensile strength 1128 MPa, elongation at break 3.0% at room temperature (Example la in Table I); and a yield strength of 673 MPa, a tensile strength of 829 MPa and an elongation at break of 9.7% at 650° C. as is seen from Example 2a in Table I.

Round material was subjected to the thermomechanical treatment according to the invention, wherein the material was deformed by 76.6% in six steps at 950° C. and then rapidly quenched. This was followed by solution annealing at 1050° C. for 20 minutes and subsequent quenching in water. Eventually, the material was annealed at 700° C. for 4 hours. The tensile properties obtained thereafter have been set forth in the following Table I as Example 1 (at room temperature) and as Example 2 (at 650° C.).

TABLE I

| Example | Yield point MPa | Tensile strength MPa | Elongation at Break % |
|---|---|---|---|
| 1 | 1417 | 1639 | 2.1 |
| 1a | 907 | 1128 | 3. |
| 2 | 987 | 1139 | 3.2 |
| 2a | 673 | 829 | 9.7 |

The following Table II shows the number of stress cycles under various tension amplitudes until the sample is broken. Example 1 refers to the alloy treated according to the invention, while Example 1a represents the untreated alloy. The tests were carried out at room temperature in the laboratory air under tension/compression (R = −1) at a frequency of about 100 Hz and sinusoidal load.

TABLE II

| Amplitude of Tension MPa | EXAMPLES 1 | 1a |
|---|---|---|
| 850 | 22 900 | |
| 825 | 1 318 300 | |
| 800 | 1 214 500 | 12 500 |
| 750 | | 33 000 |
| 700 | | 2 220 400 |

FIG. 1 shows the dependency of the tensile strength (ultimate tensile strength, UTS), the yield point (yield strength, YS), the elongation at break (El.) and the constriction at break (reduction in area, RA) on the temperature of solution annealing according to Example 1 of the invention. From FIG. 1 there is evident the surprisingly high increase of the strength obtained by the process according to the invention. In FIG. 1, ST stands for the variable solution annealing temperature. Solution annealing at the specified temperature for 20 minutes was followed by quenching with water, ageing and/or stress-relief annealing at 700° C. for 4 hours and subsequent cooling under air.

Deformation was carried out by swaging at 950° C.

Figure 2:
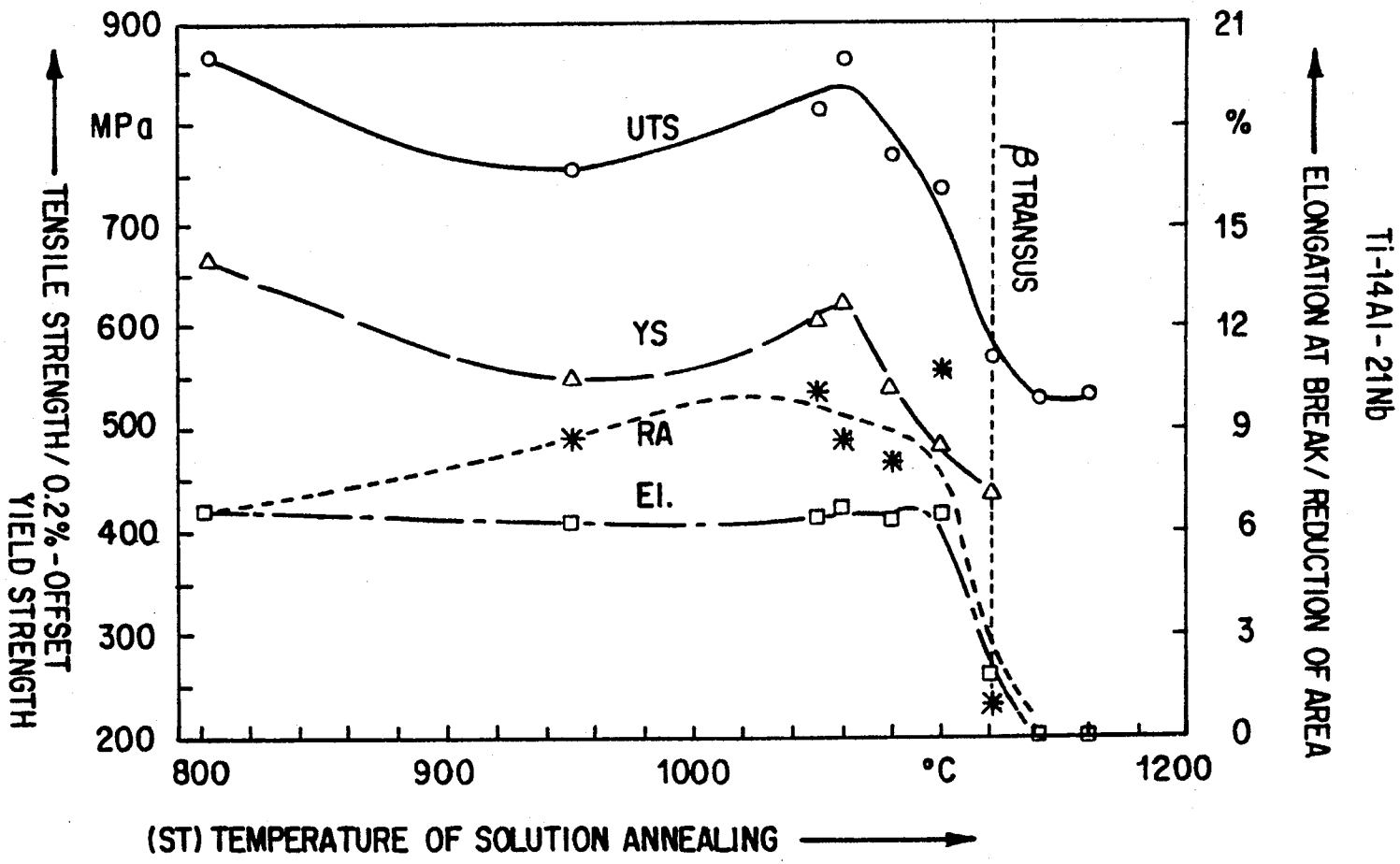
FIG. 2 shows a comparison of the same measurements for the non-inventive Alpha-2 alloy (Ti-14Al-21Nb).

FIG. 2 (comparison) shows in an analogous manner the results of the thermomechanical treatment of the non-inventive $\alpha_2$ alloy. From FIG. 2 it will be apparent that the thermomechanical treatment of the non-inventive $\alpha_2$-alloy (Ti-14Al-21Nb) under the same conditions as in FIG. 1 will hardly result in any increase in the strength values upon a variation of the solution annealing temperature. This clearly demonstrates the advantage attained by the presence of additional alloying elements stabilizing the $\beta$ phase such as, e.g., Mo or V.

Figure 3:
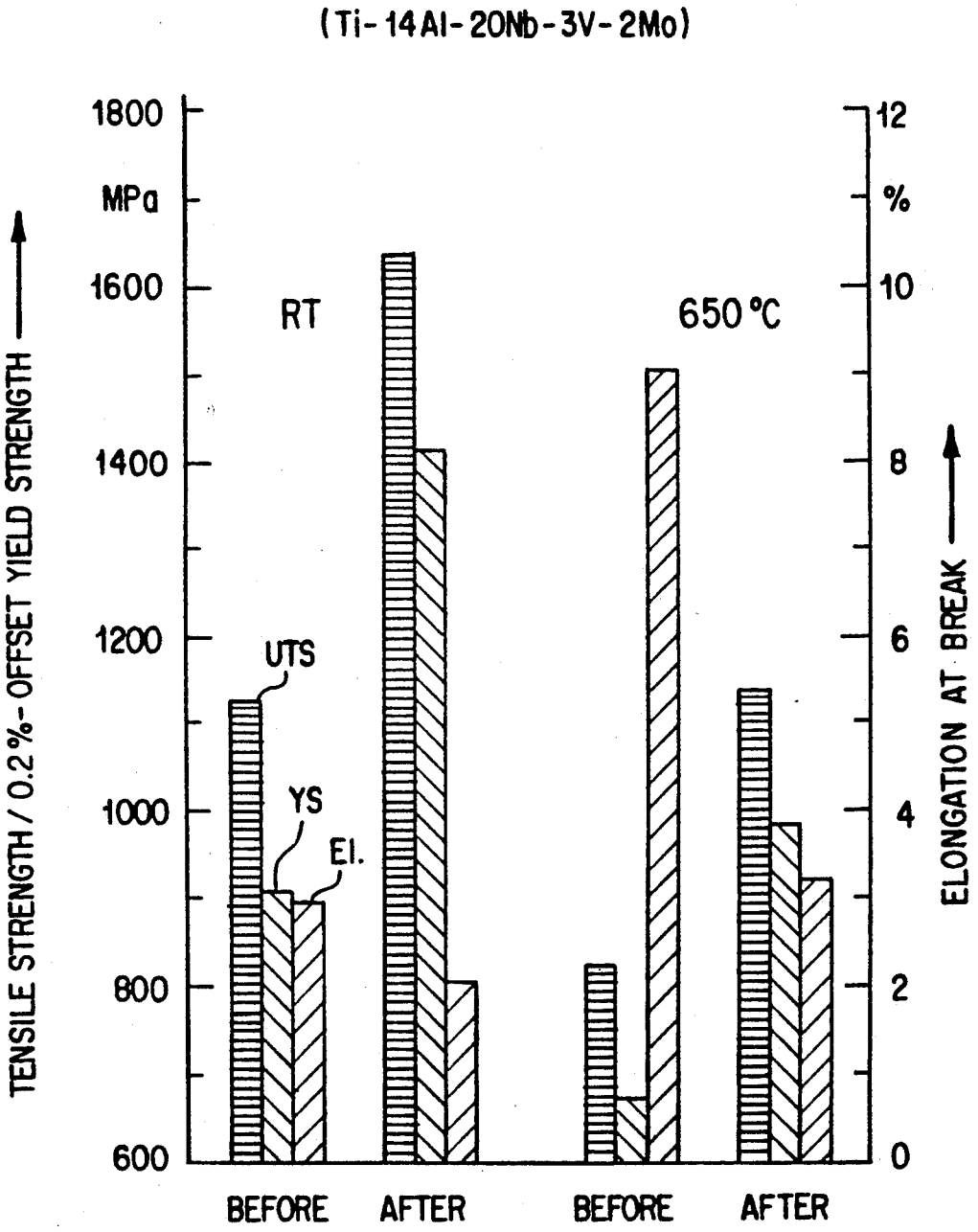
FIG. 3 gives UTS, YS, and El. data for the Super-Alpha-2 alloy both before and after the thermomechanical treatment of the present invention.
Figure 4:
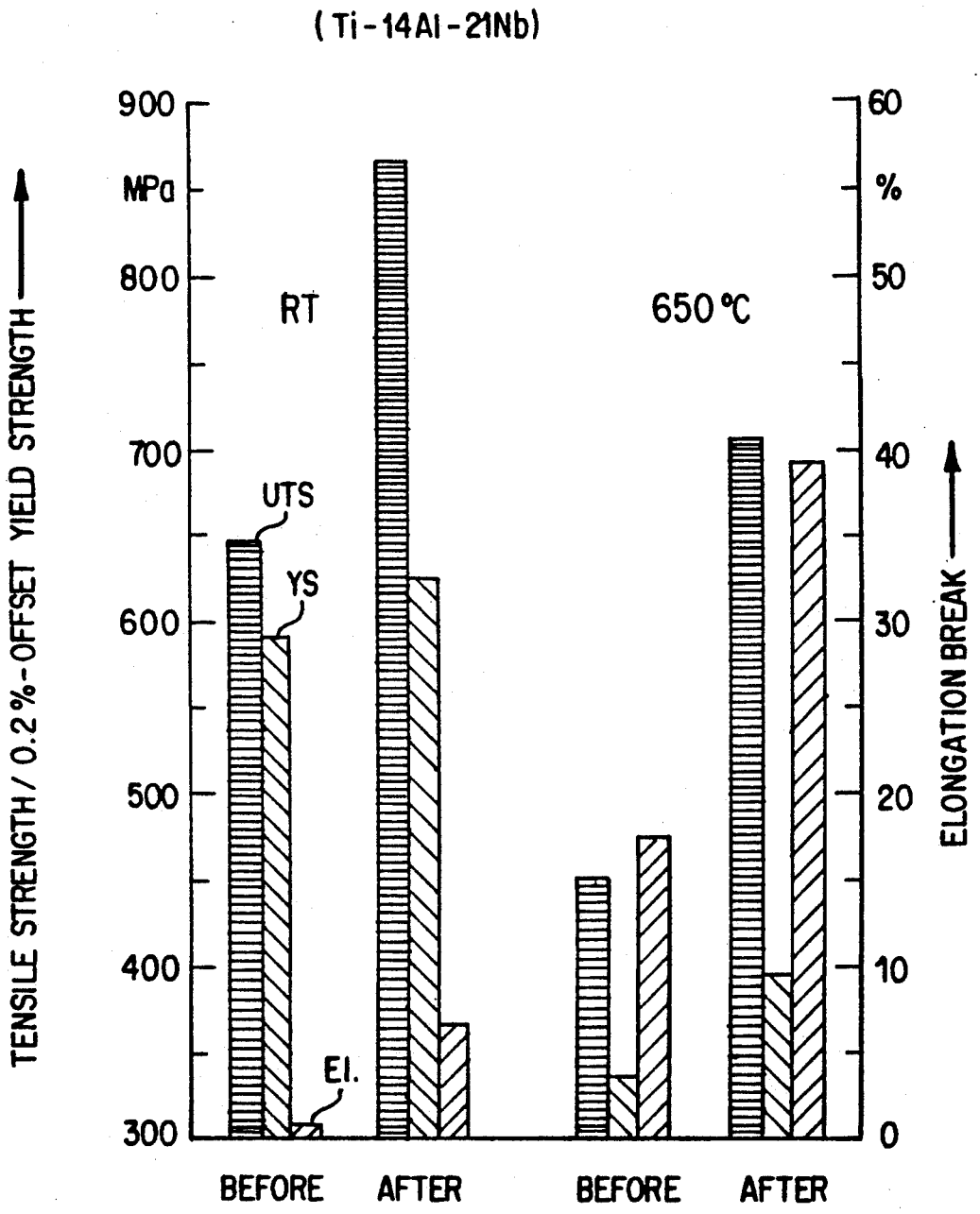
FIG. 4 gives UTS, YS, and El. data for the non-inventive Alpha-2 alloy both before and after thermomechanical treatment according to the present invention.

In the FIGS. 3 and 4, the data of tensile strength (UTS), yield point (YS) and elongation at break (El.) obtained before and after the thermomechanical treatment according to the invention of the alloys are compared. FIG. 3 shows the results obtained with the "Super-Alpha-2" alloy according to the invention, while FIG. 4 shows the results obtained with the non-inventive "Alpha-2" alloy before and after the thermomechanical treatment.

Due to the improvement described of the static and dynamic mechanical properties of the materials prepared according to the invention, it is evident that thereby the range of application of high-strength $(\alpha_2+\beta)$-alloys can be considerably enlarged in cases of static as well as dynamic strains, which fact is of particular interest in the aerospace industry.

We claim:

1. A process for thermomechanically treating $Ti_3Al$-based alloys comprising, in addition to titanium and aluminum as $\alpha$ phase-stabilizing element, niobium and further elements stabilizing the $\beta$ phase in an amount of from 20 to 30% by weight, wherein the further elements stabilizing the $\beta$ phase are present in an amount of at least 4% by weight to obtain an $(\alpha_2+\beta)$-titanium alloy having a tensile strength greater than about 1100 MPa, said process comprising (a) preparing the alloys by melting or via the powder-metallurgical route, (b) deforming at a temperature within the $(\alpha_2+\beta)$-phase area by more than 60% in one or more steps with stress-relief annealing without complete recrystallization effected between these steps, (c) solution annealing the formed part for from 5 minutes to 120 minutes below the $\beta$-transus temperature of the alloy then, (d) quenching, and (e) subsequent ageing/stress-relief annealing at temperatures within the range of from 500° to 750° C. for from 0.5 to 24 hours.

2. The process according to claim 1, characterized in that alloys comprising 5% by weight of molybdenum and vanadium as $\beta$ phase-stabilizing elements in addition to niobium.

3. The process according to claim 1, characterized in that the total contents of $\beta$ phase-stabilizing elements is 25% by weight.

4. The process according to claim 1, characterized in that Ti-14Al-20Nb-3V-2Mo (in % by weight) is employed as the alloy.

5. The process according to claim 1, characterized in that the alloys are deformed by forging, pressing, swaging, rolling or drawing.

6. The process according to claim 1, characterized in that the shaped part is solution-annealed from from 5 minutes to 30 minutes.

7. The process according to claim 1, characterized in that the shaped part is solution-annealed at a temperature which is by from 5° C. to 60° C. below the $\beta$-transus temperature.

8. The process according to claim 1, characterized in that ageing/stress-relief annealing is effected at from 650° C. to 700° C.

9. The process according to claim 1, characterized in that ageing/stress-relief annealing is effected for from 0.5 to 6 hours.

* * * * *